US009030088B2

(12) United States Patent
Yeh

(10) Patent No.: US 9,030,088 B2
(45) Date of Patent: May 12, 2015

(54) INDUCTION FLUORESCENT LAMP WITH AMALGAM CHAMBER

(76) Inventor: John Yeh, Chino Hills, CA (US)

( * ) Notice: Subject to any disclaimer, the term of this patent is extended or adjusted under 35 U.S.C. 154(b) by 554 days.

(21) Appl. No.: 13/466,040

(22) Filed: May 7, 2012

(65) Prior Publication Data

US 2013/0293102 A1 Nov. 7, 2013

(51) Int. Cl.

| | |
|---|---|
| ***H01J 1/62*** | (2006.01) |
| ***H01J 63/04*** | (2006.01) |
| ***H01J 7/20*** | (2006.01) |
| ***H01J 7/22*** | (2006.01) |
| ***H01J 61/28*** | (2006.01) |
| ***H01J 65/04*** | (2006.01) |

(52) U.S. Cl.
CPC ... *H01J 7/20* (2013.01); *H01J 7/22* (2013.01); *H01J 61/28* (2013.01); *H01J 65/048* (2013.01)

(58) Field of Classification Search
USPC ..... 313/485, 490
See application file for complete search history.

(56) References Cited

U.S. PATENT DOCUMENTS

| | | | | |
|---|---|---|---|---|
| 5,500,567 | A | 3/1996 | Wilson et al. | |
| 5,757,129 | A * | 5/1998 | Schafnitzel et al. | 313/565 |
| 6,528,953 | B1 | 3/2003 | Pearson et al. | |
| 6,597,105 | B1 | 7/2003 | Oga et al. | |
| 6,653,775 | B1 | 11/2003 | Speer et al. | |
| 6,784,609 | B2 | 8/2004 | Speer et al. | |
| 6,849,998 | B2 | 2/2005 | Shaffer | |
| 6,891,323 | B2 | 5/2005 | Lima et al. | |
| 6,906,460 | B2 * | 6/2005 | Busai et al. | 313/565 |
| 6,913,504 | B2 * | 7/2005 | Zaslavsky et al. | 445/53 |
| 7,990,041 | B2 | 8/2011 | Carter et al. | |
| 2003/0020402 | A1 * | 1/2003 | Kiermaier | 313/546 |
| 2003/0020406 | A1 * | 1/2003 | Kiermaier | 313/625 |
| 2010/0134000 | A1 * | 6/2010 | Carter et al. | 313/552 |
| 2010/0187971 | A1 * | 7/2010 | Li | 313/485 |
| 2013/0293102 | A1 * | 11/2013 | Yeh | 315/34 |
| 2014/0320009 | A1 * | 10/2014 | Goscha et al. | 315/51 |

* cited by examiner

*Primary Examiner* — Adam Houston
(74) *Attorney, Agent, or Firm* — Eric Gani

(57) ABSTRACT

A fluorescent lamp has an amalgam chamber that is in communication with the interior of the lamp through an exhaust tube. The amalgam chamber is constructed as a three-way junction with the exhaust tube and is formed at a supplementary angle of 180 degree or less with respect to the exhaust tube. The construction of the chamber utilizes the force of gravity to keep the amalgam away from the opening of the exhaust tube leading to the interior of the lamp. The amalgam chamber is capable of effectively retaining the amalgam within the chamber and preventing it from penetrating into the interior of the lamp regardless of mounting direction.

8 Claims, 2 Drawing Sheets

INDUCTION FLUORESCENT LAMP WITH AMALGAM CHAMBER

TECHNICAL FIELD

The present invention relates generally to fluorescent lamps and more particularly to placement and retention of an amalgam in an electrodeless fluorescent lamp for allowing multi-orientation operation.

BACKGROUND OF THE INVENTION

Fluorescent lamp which have a higher degree of efficiency and a longer operating life compared with an incandescent lamp, have been widely used as an alternative light source to replace incandescent lamp. Moreover, recently, in addition to conventionally used fluorescent lamps, electrodeless fluorescent lamps have been put to practical use and been under development. These electrodeless fluorescent lamps are also commonly known as electromagnetic induction lamps or simply induction lamps. Many electrodeless fluorescent lamps rely for operation on the presence of mercury in the lamp envelope. Most of them use solid mercury or mercury amalgam.

In this form, the mercury is compounded with other metals, similar to the amalgam once widely used in dental fillings. It will not release toxic mercury vapor when exposed to room temperature and poses no threat of contamination. The use of amalgam, aside from eliminating the risk of mercury contamination is also used to regulate the mercury vapor pressure inside the lamp vessel that will ultimately affect the lamp efficiency. The amalgam can also be easily recovered in the case of lamp breakage and simpler to recycle at end of lamp life.

Electrodeless fluorescent lamps typically include at least one slender tube that has an opening into the interior of the lamp envelope and which, in construction of the lamp, is used as an exhaust and fill conduit. The mercury amalgam is typically placed inside this exhaust tube prior to the tube being hermetically sealed at completion of manufacture. This presents a problem especially when the lamp is mounted in a direction such that the opening of the exhaust tube is pointed downwardly. In certain instances when the amalgam melts or disintegrates, it tended to drop by gravity into the interior of the lamp envelope where it can cause changes in the lumen output and the lumen temperature performance of the lamp, which ultimately reduces the lifetime of the lamp.

The limited mounting direction becomes a hindrance in the widespread use of electrodeless fluorescent lamps despite its many superior properties. There is thus required a means for retaining and preventing the amalgam from going inside the lamp envelope regardless of mounting direction. A look into the prior arts discovered multiple patents that might be relevant. However, none of them possesses the novelty of the instant invention.

SUMMARY OF THE INVENTION

The present invention is directed to a fluorescent lamp having an amalgam chamber to allow multi-directional operation. The instant invention is useful for all lamps that rely on the use of mercury vapor for its operation and in particular to an electrodeless fluorescent lamp that utilizes a mercury amalgam. The fluorescent lamp according to the present invention can be any conventional fluorescent lamp known in the art. Typical lamp comprises a glass tube filled with inert gas and sealed in a vacuum tight manner, an induction coil, and an exhaust tube. The instant invention introduces an additional innovative feature to the lamp in the form of an amalgam chamber.

The amalgam chamber is configured to form a three-way junction with the exhaust tube and can be constructed as either an arc tube or a straight tube. The junctions formed by the chamber are disposed at a supplementary angle of 180 degree or less with respect to the exhaust tube. Exemplary embodiments of the chamber that can be formed according to the above conditions include but not limited to a T-shape, an arrow, a traditional anchor, etc. In this configuration, the chamber can effectively retain the amalgam within the chamber and prevent it from penetrating into the interior of the lamp envelope regardless of mounting direction.

In view of the above disclosure, it is an object of the present invention to provide a fluorescent lamp capable of being mounted in any possible direction.

Another object of the invention is to provide an amalgam chamber for a fluorescent lamp that can effectively prevent a mercury amalgam from going into the interior of the lamp.

It is also an object of the invention to provide a low cost and reliable means to retain a mercury amalgam within an amalgam chamber during operation.

These and other objects of the invention will be made apparent to one of skill in the art upon a review of this specification, the associated drawings and the appended claims.

BEST MODES OF CARRYING OUT THE INVENTION

Figure 1:
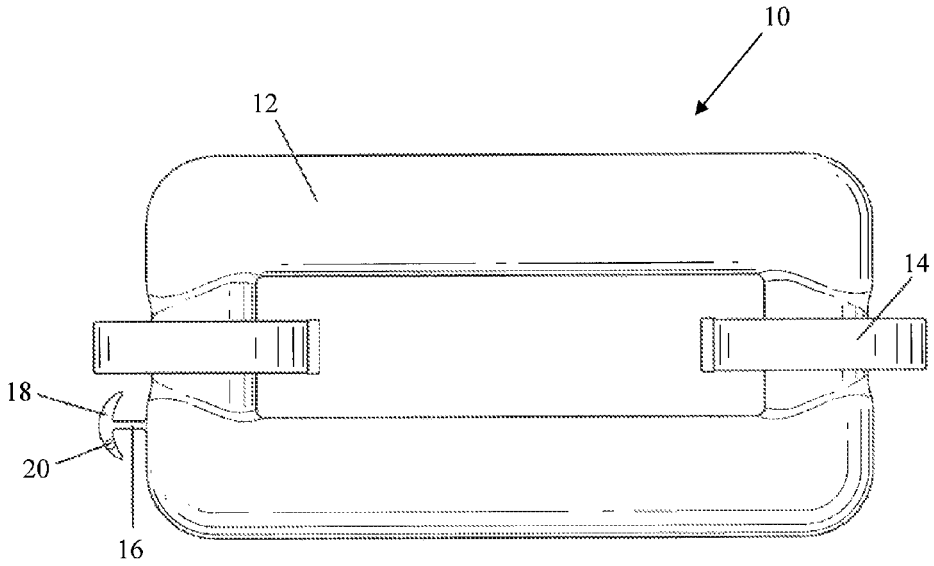
FIG. 1 is a top elevational view of the electrodeless fluorescent lamp showing the amalgam chamber according to one embodiment of the present invention
Figure 2:
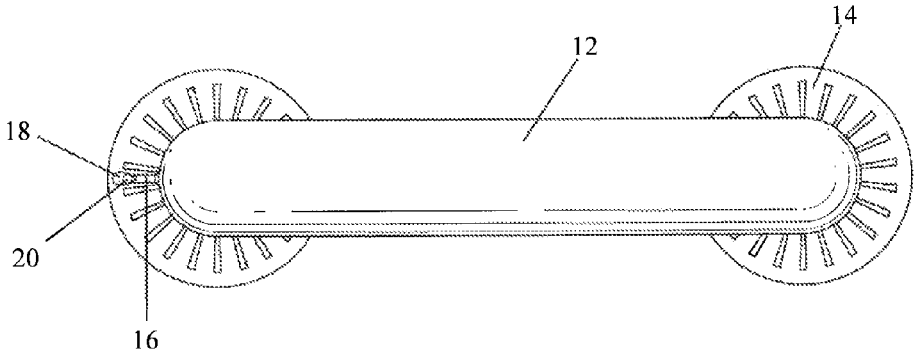
FIG. 2 is a front elevational view of the electrodeless fluorescent lamp showing the amalgam chamber according to one embodiment of the present invention
Figure 3:
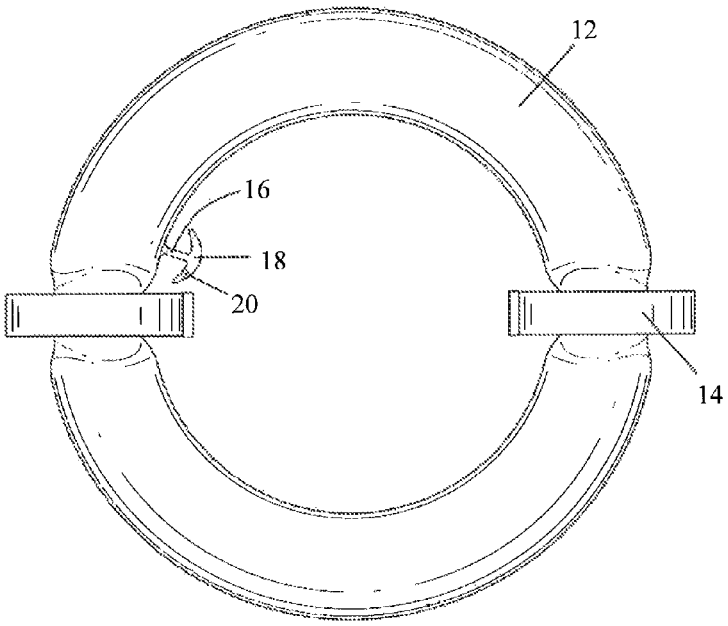
FIG. 3 is a top elevational view of a circular electrodeless fluorescent lamp showing the amalgam chamber according to one embodiment of the present invention.

The best mode of carrying out the invention is presented in terms of a preferred embodiment of an electrodeless fluorescent lamp 10 having an amalgam chamber 18 as illustrated in FIGS. 1-5. The electrodeless lamp 10 as shown in FIGS. 1-3 can be any conventional electrodeless fluorescent lamp known in the art. Typical electrodeless fluorescent lamp will have a glass tube 12 coated with a phosphor layer on its inner surface, filled with a mixture of inert gas and mercury vapor and sealed in a vacuum tight manner. One or more induction coil 14 typically wrapped around a portion of the tube 12 and at least one exhaust tube 16 containing a mercury amalgam 20 is disposed of in the vicinity of the coil 14. The exhaust tube of prior art fluorescent lamp has one closed end and one open end that is in communication with the interior of the glass tube. When operated in a direction where the open end is facing downward, there is a possibility that the amalgam can penetrate into the lamp tube and destroy the lamp life.

Figure 4:
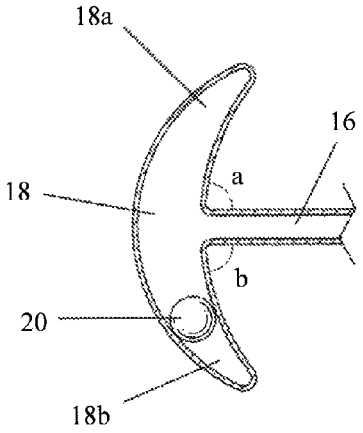
FIG. 4 is a cross sectional view of the exhaust tube and amalgam chamber according to the preferred embodiment of the present invention.
Figure 5:
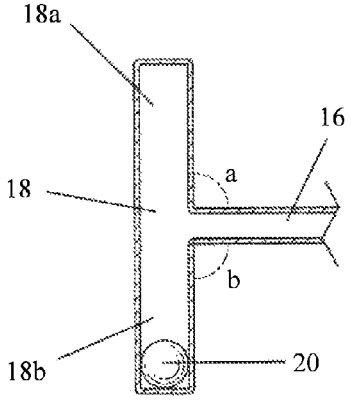
FIG. 5 is a cross sectional view of the exhaust tube and amalgam chamber according to an alternative embodiment of the present invention.

The electrodeless fluorescent lamp 10 according to the instant invention solves the problem associated with the prior arts lamp by providing an innovative amalgam chamber 18 that is integrally connected to the exhaust tube 16 as illustrated in FIGS. 1-5. Referring now to FIG. 4 and FIG. 5, the amalgam chamber 18 is constructed to form a three-way junction with the exhaust tube 16 with the chamber 18 forming the first junction 18*a* and the second junction 18*b* while the exhaust tube 16 forms the third and main junction. The amalgam chamber 18 is constructed such that the first junction 18*a* and the second junction 18*b* are formed at supplementary angles of 180 degree or less with respect to the exhaust tube 16. That is, the sum of angle 'a' and angle 'b' is 180 degree or less. This can be accomplished by forming the amalgam chamber 18 either as an arc tube as illustrated in FIGS. 1-4 where the supplementary angles are shown at less than 180 degree or as a straight tube as illustrated in FIG. 5 where the supplementary angles are shown at 180 degree with respect to the exhaust tube 16.

The exhaust tube 16 has an opening on one end that is in communication with the interior of the lamp 10 and has an opening on the other end that is in communication with the interior of the amalgam chamber 18. In this configuration, the exhaust tube 16 acts as a bridge to facilitate the necessary mercury vapor to flow between the chamber 18 and the interior of the lamp 10. The size of the opening of the exhaust tube 16 should be smaller than the size of the amalgam 20. The amalgam 20 utilized for the purpose of this invention can be any conventional amalgam that is known in the art of mercury vapor discharge lamp. An exemplary amalgam comprises pure indium or a combination of bismuth and indium. Another exemplary amalgam comprises a combination of lead, bismuth and tin. Still another exemplary amalgam may comprise zinc or a combination of zinc, indium and tin.

The construction of the amalgam chamber 18 disclosed in the instant application provides ample volume to contain the mercury amalgam 20 while still permits the necessary mercury vapor to flow between the chamber 18 and the tube 12. The chamber 18 construction will allow installation of the lamp 10 in any position in which the lamp 10 may be operated including a mounting where the exhaust tube 16 opening is facing downward. This is because the amalgam 20 in the present invention is enclosed within the amalgam chamber 18 that is designed such that the force of gravity will cause the amalgam 20 to be positioned in a location away from the opening of the exhaust tube 16.

It is easy to visualize the operation of the amalgam chamber 18 according to the instant invention. When the lamp 10 is mounted in a vertical direction such that the chamber 18 is in a position as shown in FIG. 4, the amalgam will be positioned in the lowest junction 18*b* of chamber 18 due to the force of gravity. When the lamp 10 is mounted in the opposite direction, it is clear that the force of gravity will cause the amalgam 20 to be positioned in junction 18*a*. Referring back to FIG. 4, if the lamp is mounted such that the opening of the exhaust tube 16 is facing upward, it is understood that the amalgam 20 will be positioned somewhere along the wall of the chamber 18 away from the opening to the exhaust tube 16.

The major problem associated with the amalgam placement in the prior art is that the amalgam is located inside the exhaust tube. When the lamp is mounted in a direction such that the opening of the exhaust tube is facing downward, the amalgam tends to penetrate into the glass tube by force of gravity. It is apparent from the instant invention when the lamp 10 is mounted in such direction where the opening of the exhaust tube 16 is facing downward, the amalgam 20 will be retained within the chamber 18. This is because in this orientation, the opening to the exhaust tube 16 is at the apex of the chamber 18. The force of gravity will cause the amalgam 20 to slide down and be positioned in either junction 18*a* or junction 18*b*. Thus averting the possibility of the amalgam 20 to drop and penetrate into the glass tube 12. It can also be understood that when the lamp 10 is mounted in a horizontal direction such that the chamber 18 is in a position as shown in FIG. 2, the amalgam 20 will be positioned and retained within the chamber 18 since gravity will not cause the amalgam 20 to move sideways. One can mount the lamp 10 in any possible direction and should be able to envision the amalgam 20 to be retained and positioned somewhere within the chamber 18 at all time.

The amalgam chamber 18 according to the instant invention utilizes the force of gravity to retain the amalgam 18 within the chamber 18 and prevent it from penetrating into the interior of the lamp 10. The use of amalgam chamber 18 described herein provides a low cost and reliable means for retaining the amalgam 20 within the amalgam chamber 18 of fluorescent lamps, thus providing lamps which are rendered multi-directional with regard to mounting in fixtures and lighting applications and will provide stable performances under vibration applications such as can be encountered during handling and transportation. The fluorescent lamp 10 as disclosed in the present invention solves the prior art problem associated with the limited mounting direction and alleviate the risk of the amalgam 20 penetrating into the lamp tube 12 which can potentially reduce the efficiency and the life of the lamp and void manufacturer's warranty.

Although the invention has been described in some detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claim.

The invention claimed is:

1. A fluorescent lamp comprising:

a) a glass tube sealed in a vacuum tight manner and contain a mixture of inert gas and mercury vapor, b) at least one induction coil wrapped around a portion of the tube, c) at least one exhaust tube having an amalgam chamber containing an amalgam, wherein said amalgam is retained within the chamber regardless of the lamp mounting direction.

2. The fluorescent lamp as specified in claim 1 wherein said exhaust tube has one open end in communication with the interior of said glass tube and an opening on the other end that is in communication with the amalgam chamber.

3. The fluorescent lamp as specified in claim 2 wherein said opening has a size that is smaller than the size of the amalgam.

4. The fluorescent lamp as specified in claim 1 wherein said amalgam chamber is constructed to form a three-way junction with the exhaust tube.

5. The fluorescent lamp as specified in claim 4 wherein said chamber further comprises of an arc tube or a straight tube.

6. The fluorescent lamp as specified in claim 4 wherein said chamber is formed at a supplementary angle of 180 degree or less with respect to the exhaust tube.

7. The fluorescent lamp as specified in claim 1 wherein said chamber is designed such that the force of gravity will always keep the amalgam away from the opening of the exhaust tube to prevent the amalgam from going into the interior of the lamp.

8. An amalgam chamber for a fluorescent lamp, said chamber containing an amalgam and provided with an opening that is in communication with the interior of the lamp through an exhaust tube, said chamber is constructed to form a three-way junction with said exhaust tube and is formed at a supplementary angle of 180 degree or less with respect to said exhaust tube, wherein said chamber is capable of retaining the amalgam within the chamber and preventing it from penetrating into the interior of the lamp regardless of the lamp mounting direction.

* * * * *